US006247618B1

(12) United States Patent
Liberatore

(10) Patent No.: US 6,247,618 B1
(45) Date of Patent: Jun. 19, 2001

(54) ROLL UP TUBE DISPENSER WITH SHELL HOUSING

(76) Inventor: Raymond A. Liberatore, 12143 Pumpkin Hollow Rd., Bentonville, AR (US) 72712

( * ) Notice: Subject to any disclaimer, the term of this patent is extended or adjusted under 35 U.S.C. 154(b) by 0 days.

(21) Appl. No.: 09/425,563

(22) Filed: Oct. 22, 1999

(51) Int. Cl.[7] ..... B65D 35/34
(52) U.S. Cl. ..... 222/100
(58) Field of Search ..... 222/98, 99, 100, 222/103

(56) References Cited

U.S. PATENT DOCUMENTS

| | | | |
|---|---|---|---|
| 955,530 | 4/1910 | Morrison | 222/99 |
| 1,692,213 | 11/1928 | Kielberg | 222/99 |
| 1,770,946 | 7/1930 | Rostiser . | |
| 1,797,727 | 3/1931 | Spisa . | |
| 1,986,409 | 1/1935 | Redmer . | |
| 2,531,060 | 11/1950 | Krueger | 222/99 |
| 2,545,773 | 3/1951 | Gonzalez | 222/99 |
| 2,851,195 | 9/1958 | Widmann | 222/100 |
| 3,473,698 | 10/1969 | Ballin | 222/100 |
| 3,885,708 | 5/1975 | Parry | 227/100 |
| 3,920,157 | 11/1975 | Yeung | 222/100 |
| 4,570,828 | 2/1986 | Wood | 222/100 |
| 4,576,314 | 3/1986 | Elias et al. | 222/97 |
| 4,653,670 | 3/1987 | Kendrick | 222/99 |
| 4,664,293 | 5/1987 | Sheppard | 227/99 |
| 5,097,987 | 3/1992 | Liberatore | 222/1 |
| 5,685,457 | 11/1997 | Liberatore | 222/100 |

FOREIGN PATENT DOCUMENTS

| | | |
|---|---|---|
| 125349 | 3/1927 | (CH) . |
| 238430 | 7/1945 | (CH) . |
| 798687 | 5/1936 | (FR) . |
| 370204 | 4/1931 | (GB) . |

*Primary Examiner*—Joseph A. Kaufman
*Assistant Examiner*—Patrick Buechner

(57) ABSTRACT

An apparatus including a pair ofhousing halves cooperating, when together, to define a take up compartment with nesting bores and flattening edges to compress a flexible wall tube as it is drawn into the housing through operation of a knob attached to a reel resting in the nesting bores and connected to the closed end of the tube and rotatably mounted to the housing. Breaking elements are also provided to inhibit unreeling of the emptied portions of the tube.

10 Claims, 8 Drawing Sheets

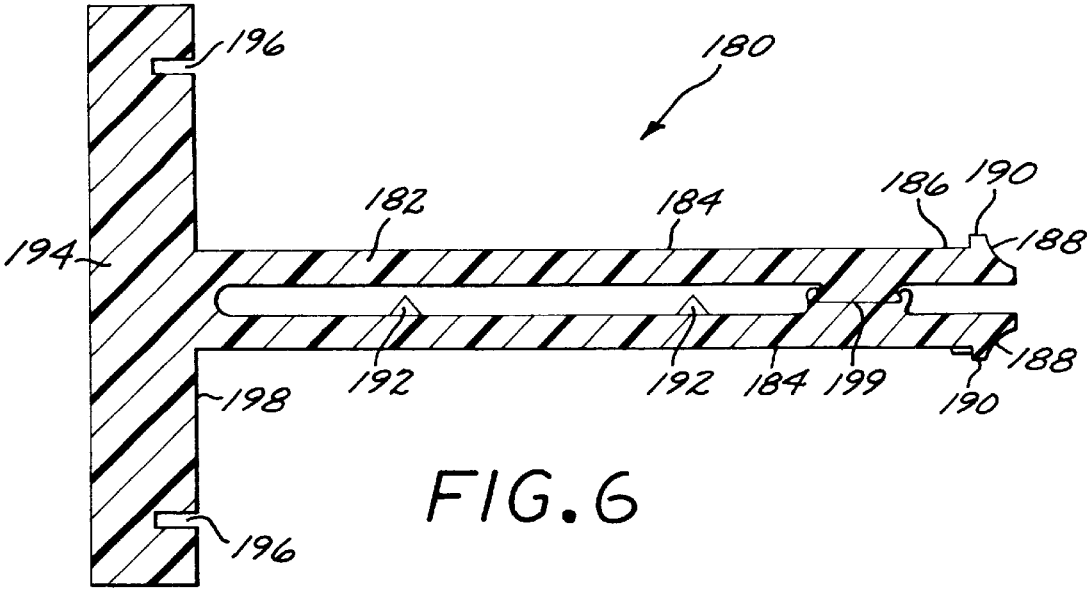
FIG. 6
FIG. 7
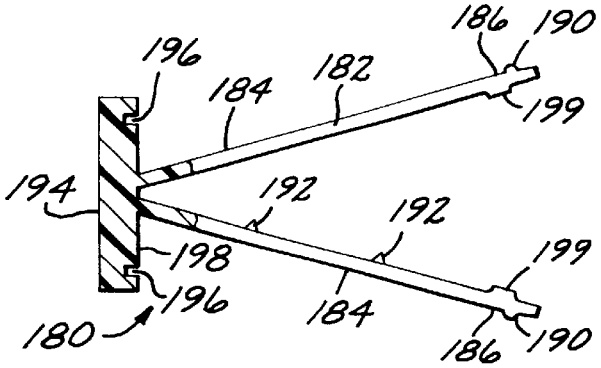
FIG. 8B
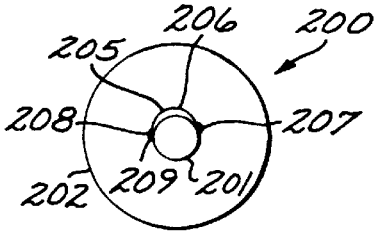
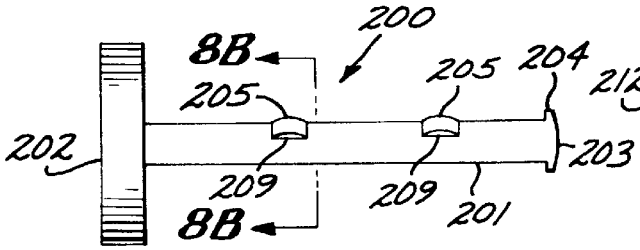
FIG. 8A
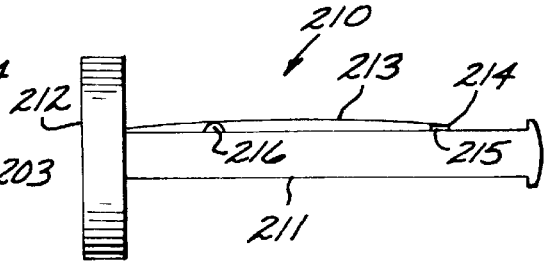
FIG. 9

FIG. 10
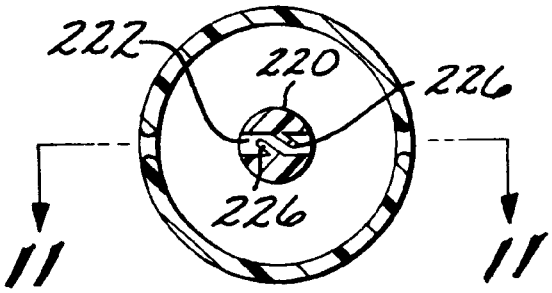
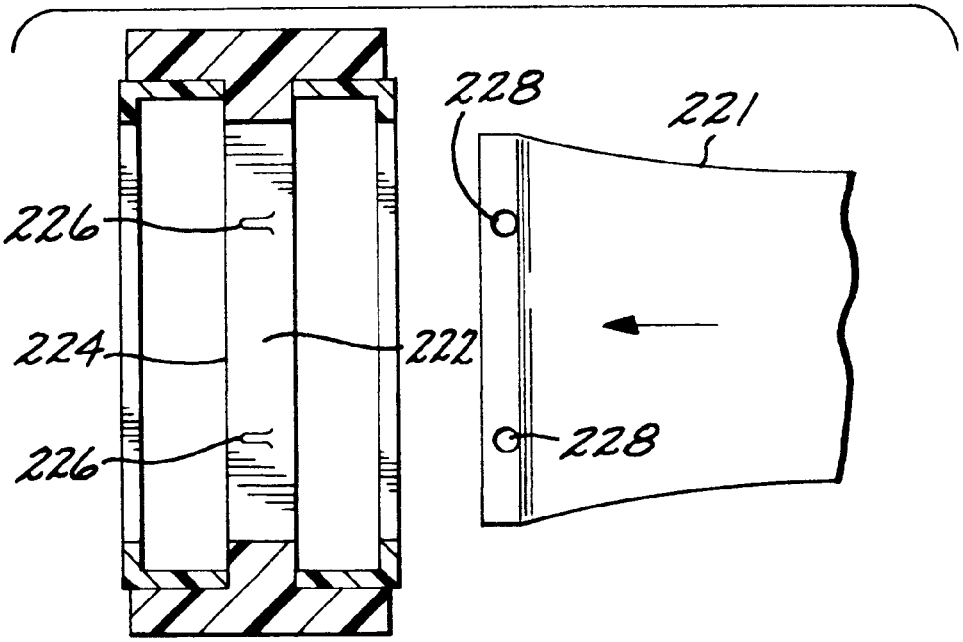
FIG. 11

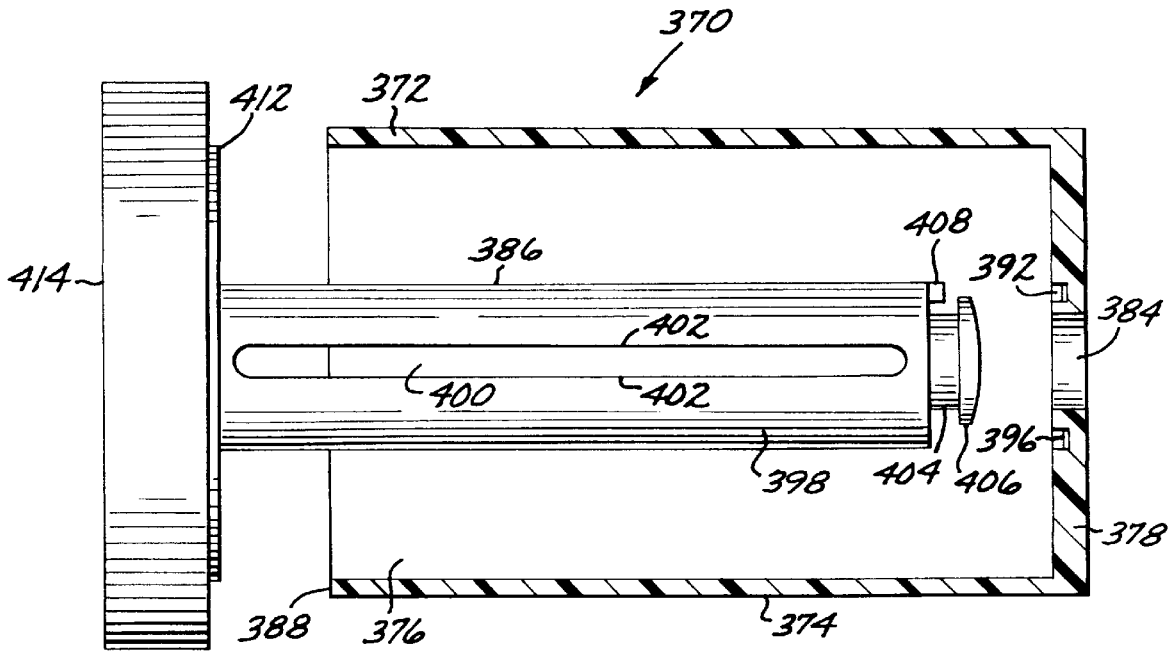
FIG. 16
FIG. 17
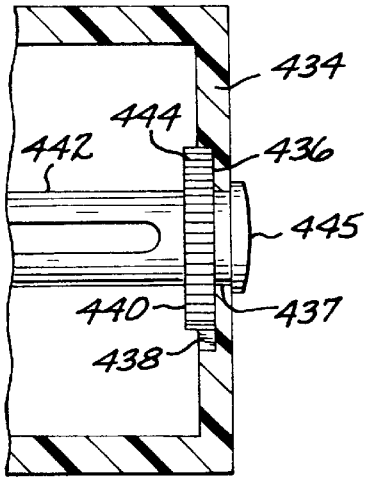

ROLL UP TUBE DISPENSER WITH SHELL HOUSING

BACKGROUND OF THE INVENTION

1. Field of the Invention

The invention relates generally to dispensers for extruding the contents of flexible walled tubes, and more specifically to an improved roll up tube dispenser having a shell housing.

2. Description of the Prior Art

Flexible dispensing containers provide advantages over other forms of product packaging, because such tubes are relatively clean and manually squeezable to controllably expel small amounts of the stored product outwardly through an orifice or nozzle. These tubes also provide a convenient means for expelling contents having significant viscosity.

These collapsible containers are generally formed by an integral, flexible wall configured on one end with a conventional outlet and cap. The opposite end of the tube is generally left unsealed to form a wide opening to be filled with a paste-like product and closed.

The contents of such a tube are then generally ejected at the time of use by removing the cap and then manually squeezing the tube walls. This method generally results in a random movement of the stored contents. The movement of the contents is in response to the compression of the tube walls caused by the squeezing. While a relatively full tube may be easily manipulated to orderly expel the paste product, as the tube approaches empty, manipulation of the flexible walls thereof may only serve to manipulate the remaining product back and forth in the tube itself. Efforts to squeeze the final remnants of the product often results in the user locating a flat edged apparatus to forcefully flatten the tube from the rear end towards the tube nozzle, thereby urging the contents in one direction only, and ultimately out of the tube.

Another common approach is to roll up the tube by hand starting at the closed end to force the contents from the substantially emptied portion toward the dispensing end of the tube. This may provide a temporarily satisfactory result but because the tube unwinds when the manipulating forces are removed, the process has to be repeated each time. This drawback is amplified as the length of the tube increases and is especially prevalent in tubes biased to retain a straightened configuration, such as those constructed from plastics.

Additionally, the consumer, faced with the difficulty of dispensing the final remnants of product from a relatively empty tube, often disposes of the tube with such remnants left therein. Premature disposal of consumer product packaging not only results in undue waste but is believed to contribute greatly to the rapid filling of available landfills. Collapsible tubes in particular, often contain a measurable percentage of the original product when disposed. Use of the typically wasted product by consumers would thus have a substantial impact on the environment through conservation of available landfill space by reducing the number ofprematurely disposed collapsible tubes.

One alternative proposed to dispense the contents of a collapsible walled tube involves attaching a narrow elongated rod, commonly called a key, to the crimped end of a conventional metallic tube. Examples of these devices can be found in U.S. Pat. No. 955,530 to Morrison; U.S. Pat. No. 1,770,946 to Rostiser; U.S. Pat. No. 1,986,409 to Redmer; U.S. Pat. No. 2,545,773 to Gonzalez; and U.S. Pat. No. 4,653,670 to Kendrick. While devices of this nature aid in rolling up the tube they do not prevent unwinding of the tube, particularly tubes made from plastics.

Other devices proposed to deal with these problems provide a means for enabling consumers to incrementally control the flow of material from a tube and enable the use of substantially all of the available contents. These rotatable reel type dispensers generally include a housing having a slot for receiving a portion of the tube and internally dimensioned to accommodate a reeling assembly containing a slot for insertion of one end of the tube. The reel is turned by some means such as a wheel and the tube is drawn through the housing slot which forces the contents toward the dispensing end and ultimately out of the tube. These devices typically rely on friction between the housing and the tube or the inherent flexibility of the tube to prevent the tube from unwinding. Plastic tubes, in particular, however, typically have great resiliency and tend to unwind unless secured in place. Therefore, reliance solely on frictional forces between the housing and the tube may not provide satisfactory results.

Other devices have been proposed to reel the tube and resist unwinding. Examples of these devices can be found in U.S. Pat. No. 4,576,314 to Elias et al.; U.S. Pat. No. 4,570,828 to Wood; and U.S. Pat. No. 5,685,457 to applicant. While applicant's invention shown in his U.S. Pat. No. 5,685,457 has enjoyed success, manufacturers sensitive to both the environment and their customers' preference for a collapsible tube prohibited from unwinding, continue to search for devices facilitating the assembly of a dispenser constructed to allow incremental flow of the material while resisting unreeling of the tube.

Due to the widespread use of collapsible tubes and problems inherent in preventing the tubes from unwinding, manufacturers prefer to permanently mount the dispenser on the collapsible walled tube and sell the combined unit as a package to offer convenience to their customers. This provides consumers with a pre-assembled package in a ready to use condition. Mass assembly of these dispensers is generally discouraged, however, due to the problems faced when initially mounting the reel to the tube. Typically, a length of the tube is inserted into a reel shaft and the reel is wound several times to satisfactorily secure the tube to the reel in a manner as to prevent the tube from being pulled off the reel. This winding process adds additional time to the assembly process and discourages mass assembly of dispenser.

The initial assembly of the tube to the reel adds assembly time in another manner. Assembly of these pre-assembled packages is generally accomplished in one of two manners. One method is to attach the tube to the reel and then the tube-reel assembly is inserted into a housing with an open ended slot thereby completing the assembly. Typically, the closed end of the tube must be precisely aligned with the narrow retainer opening in the reel. The second manner of assembly is to attach the reel to the housing and then insert the tube into a slot in the housing and then into the reel. This method requires even more precision than the first one because the reel and housing openings must be aligned. U.S. Pat. No. 5,097,987 to applicant provides an indicator that has proven successful in addressing the alignment problem but manufacturers faced with assembling an incremental dispenser constantly search for dispensers capable of saving the time and cost associated with assembling the tube and the dispenser in permanent fashion. It was this apparatus to which my application U.S. Ser. No. 09/246,681 filed Feb. 8, 1999 now U.S. Pat. No. 5,960,994, was directed.

As noted in my prior application, there are advantages to providing a number of ways for assembling such a device to reduce manufacturing time and the apparatus of my prior application addresses several different means of assembly. In some cases, however, the manufacturer or assembler prefers to use a housing that can be separated or opened up to a significant width allowing easier placement of the reel and tube end within the housing prior to final assembly of the housing. Thus, there remains a need for alternative means for assembling a roll up tube dispenser that is tailored to specific manufacturing needs. It is that alternate assembly to which this application is directed.

SUMMARY OF THE INVENTION

In accordance with the preferred embodiment of the present invention, a dispensing apparatus is provided to uniformly extrude the contents of flexible wall tubes and includes ahousing comprised of upper and lower shell halves abutting at one edge and terminating in flattening edges at the opposing surface. The two halves cooperate when together to form a take up compartment and nesting bores for receiving portions of a transverse reel mounted to a rolled up portion of the tube. The assembly process is facilitated by the use of such housing which may be hinged or two discrete halves providing a greater placement space for more rapid positioning of the reel and tube portions on one of the housing halves. Breaking surfaces are incorporated to interact with the reel to prevent the reel from unwinding in one direction and allowing the tube to unwind.

BRIEF DESCRIPTION OF THE DRAWINGS

FIG. 6 is a cross sectional front view showing a modified reel of FIG. 4;

FIG. 7 is a reduced scale cross sectional front view of the reel shown in FIG. 6 in an unfastened state;

FIG. 8A is a reduced scale front view of an alternative reel to FIG. 4 having a pair of clips;

FIG. 8B is a transverse cross sectional view taken along lines 8B—8B of FIG. 8A.

FIG. 9 is a reduced scale front view of another alternative reel to FIG. 4 having a transversely extending clip;

FIG. 10 is a transverse sectional view of a modified reel of FIG. 4;

FIG. 11 is a cross sectional view taken along lines 11—11 of FIG. 10 and illustrating a commonly manufactured tube including apertures;

FIG. 16 is an exploded front view of an alternative embodiment of the present invention with a cut away housing;

FIG. 17 is a cut away longitudinal cross section view of an alternative embodiment of the present invention;

Figure 1:
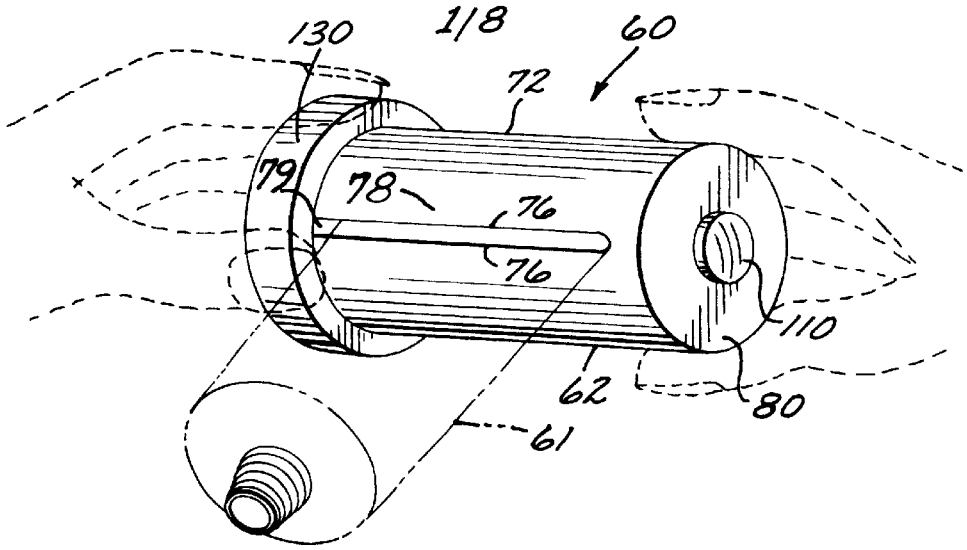
FIG. 1 is a perspective view of a dispenser apparatus incorporating the present invention.
Figure 2:
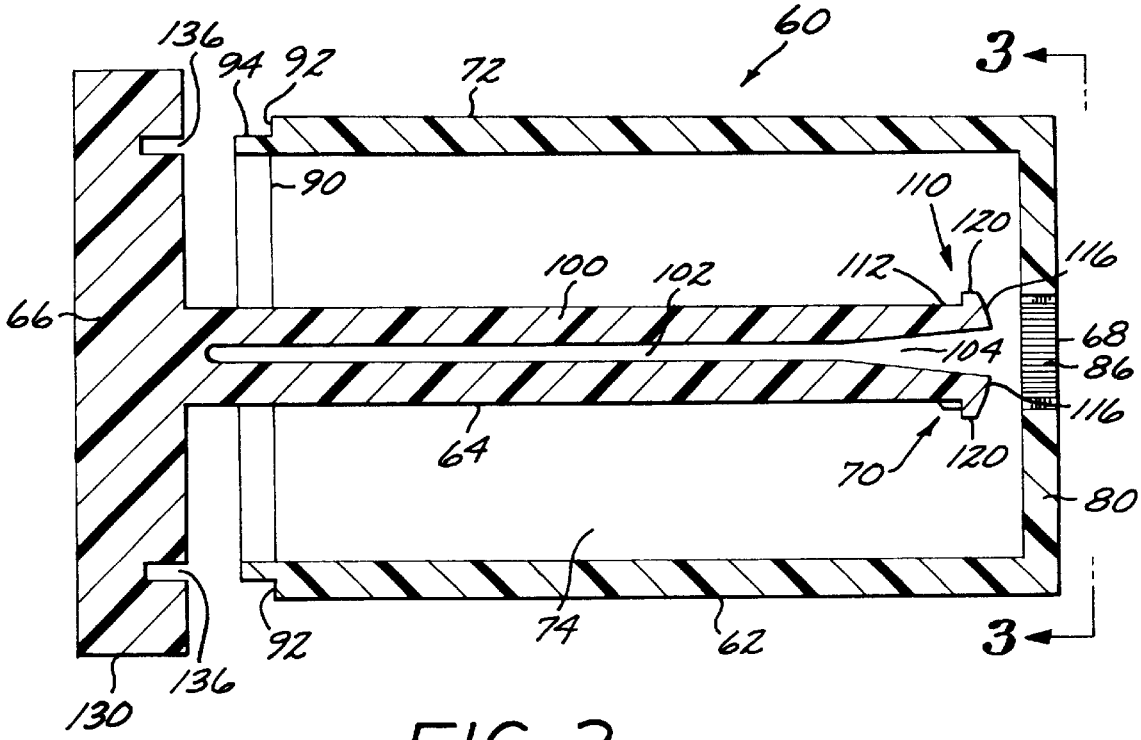
FIG. 2 is an exploded cross sectional view, in enlarged scale of a dispenser apparatus as shown FIG. 1.
Figure 3:
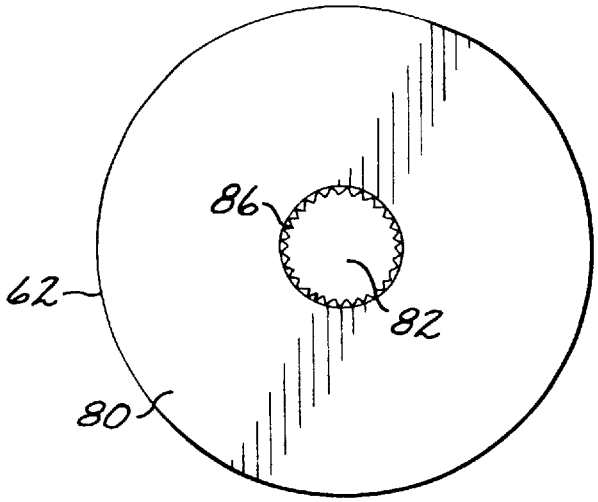
FIG. 3 is a right hand end view of the housing taken along lines 3—3 of FIG. 2.

Numerous advantages and aspects of the invention will be apparent to those skilled in the art upon consideration of the following detailed description which generally provides illustrations of the invention in its presently preferred embodiments.

DETAILED DESCRIPTION OF THE PREFERRED EMBODIMENT

Referring now to the drawings where common elements retain the same reference numbers throughout the description for purposes of clarity, FIGS. 1–5 illustrate a first preferred embodiment of an improved roll up tube dispenser apparatus, generally referred to as 60, for dispensing the contents of a flexible walled tube 61. The dispenser apparatus includes a housing 62 for compressing and storing portions of the tube, a reel 64 mounted on the housing for connecting to the tube to provide a circumferential winding surface for the tube, a knob 66 for rotating the reel, and a first braking element 68 and a second braking element 70 cooperative with the first to prevent unreeling of the reel. For purposes of this description, the extension of the housing generally defines the transverse direction.

The housing 62 is in the form of a cylindrical shell 72 defining an interior take up compartment 74 that is dimensioned to house the reel 64 and enable the tail of the tube 61 to be rolled up therein until the tube is substantially emptied. While the interior of the housing is preferably circular in cross section, the present invention is not so limited but, rather, may include a housing formed into a variety of shapes. Formed in the forward side of such shell is a transversely elongated slit 78 configured with a pair of transversely running elongated flattening edges 76 constructed to slidably engage the flexible walls of the tube as it is drawn into the take up compartment. The flattening edges may be formed of a more rigid materials to assist the compression process. The slit also has an open end 79 to accommodate assembly of the dispenser apparatus and lateral positioning of the tube.

The housing is closed on one end by an end wall 80 for providing structural integrity to the shell 72. The end wall is formed centrally with an axial through bore 82 configured with annularly arranged braking teeth 86 to engage a second braking element, generally designated 70, formed at the end of the reel to resist unreeling of the reel.

The shell 72 is formed with an open end 90 configured with a reduced in diameter annular flange 94 defining an axially outwardly facing shoulder 92. With continued reference to FIG. 2, the knob 66 is formed on its inside surface with an axially inwardly opening annular groove 136 that slidably receives the annular flange 94 for rotation thereof. The knob 66 is generally cylindrically shaped to form a cylindrical hand gripping portion 130 which may be serrated.

The reel 64 is configured so the knob 66 is formed integrally with an axial shaft 100 having a connector slot 102 formed therein for receipt of the flattened closed end of the tube 61 (FIG. 1). The slot preferably projects through the reel but may also terminate within the reel. The slot extends substantially along the reel shaft and is open at one end 104 for receipt of the flattened end of the tube.

The reel shaft 100 is preferably cylindrically shaped to provide an efficient surface for winding the tube thereon and is configured in form of a fork defining a pair of spaced apart tines 116, each formed with radially outwardly projecting resilient flanges 120 cooperating to define a fastener boss, generally designated 110. In the preferred embodiment the fastener boss is sufficiently resilient and so shaped as to form a permanent attachment to the housing once the flanges are disposed against the outer wall of the housing. However it must be appreciated that a less resilient fastener boss offers the possibility of releaseable engagement with the housing. The flattened end of the tube may be inserted in a transverse direction between the tines and into the slot 102 which frictionally retains the tube. The slot is dimensioned to accommodate the flattened end of the tube and the reel is resilient enough to compress the flattened end of the tube and prohibit the removal of the tube from the slot once assembly is complete and the reel is snapped into end wall of the housing. To facilitate assembly of the tube with the connector, the free open end 104 of the reel includes a portion in which the interior surfaces of the tines diverge away form one another in a smooth contour for transverse receipt of the flattened end of the tube. This enlarged opening and gradual transition improves assembly time and lowers costs because less precision is required to align the closed end of the tube with the slot during assembly. The remaining interior portion of the reel may be solid or can be hollowed out to save material.

Formed behind the boss 110 is a journal 112 configured with a pawl defining a braking element 70 to releasably engage the teeth 86. Multiple pawls are also contemplated by the present invention with each pawl spaced equidistantly around the circumference of the journal. Alternatively, the braking elements may be transposed such that a series of ratchet teeth projects from the journal and a pawl or series of pawls is disposed around the margin of the bore.

A variety of reels and connectors may be used in the present invention as exemplified in FIGS. 6–11. Referring now to FIGS. 6–7 a reel, generally designated 180, is formed with a forked reel shaft 182 having a pair of resilient elongated outwardly diverging flexible tines 184. Each tine terminates at its free extremity in ajournal portion 186 and a laterally outwardly projecting locking tab 188 having a rearwardly facing shoulder 190 for abutting against the closed end wall of the housing. Respective barbs 192 project inwardly from one of the tines 184 and terminate in close proximity with the interior surface of the opposing tine thereby forming a retaining area for the closed end of the tube within the reel shaft. The reel is preferably integrally formed with a knob 194 which has an axially opening annular groove 196 on its interior surface 198.

In the unfastened state, as shown in FIG. 7, the outwardly biased tines 184 define a converging path for receipt laterally therein of the closed end of the tube during assembly. This feature affords enhanced ease of assembly over that required for those devices formed with a linear closed end slot which improves assembly time and lowers costs. The closed end of the tube may be received in between the tines and the free ends of such tines drawn together to clamp the tube therebetween. The ends of the tines include an interlocking snap 199 to secure the tines together and provide structural integrity to the reel unit at the free end. Alternatively, each tine could include an inwardly projecting spacer that abuts the opposing spacer on the other tine to space the tines apart. It will also be appreciated by those skilled in the art that the number, form, and placement of the barbs between the tines can be varied and remain within the scope of the invention.

The reel shown in FIGS. 6–7 provides for a flattered tube end to be slid in between the tines transversely from the free extremity to the knob end. The flexibility of the tines also provides retention of tube ends that are not substantially flattened by providing a connector capable of differently contoured openings. Referring for example to FIG. 7, after a closed end of a tube is slid in between the tines, the tines are then forced together and interlocked by the snapping device 199 such that the tabs 188 are in close proximity relative to one another as shown in FIG. 6. The shoulders 190 of the tabs are then forced through a bore in the housing similar to the bore 82 shown in FIG. 1 until the journal 186 resides within the bore thereby forming a rotational coupling between the housing and the reel. It is preferred to permanently affix the connector with the tube to prohibit the tube from being pulled from the dispenser.

Referring now to FIGS. 8A and 8B, another example of a reel of the present invention is illustrated. The reel, generally designated 200, includes a reel shaft 201 transversely projecting from a knob 202 and terminating at its free end in a fastener boss 203. The fastener boss includes a resilient shoulder 204 for permanent attachment with a housing as described in the first embodiment. A pair of transversely spaced apart retention clips 205 is provided to retain the closed flattened end of the tube. The arcuately shaped clips are cantileverly mounted on the reel shaft. Each clip includes a resilient portion 206 that circumferentially extends around a portion of the reel shaft from a secured end 207 and terminates in a free end 208. Projecting radially interiorly of the free end is a bulbous stop 209 that abuts the outer diameter of the reel shaft. The closed flattened end of the tube may be inserted between the reel shaft and the bulbous stop of both resilient clips and retained on the reel. It is preferable to use this reel in conjunction with a tube having corresponding holes such as that shown in FIG. 11. The bulbous stops reside with the corresponding hole and prevent the tube from being withdrawn from the reel. Use of the clips decreases assembly time by removing the requirement of winding the tail end of the tube on the shaft to retain it thereon.

As shown in FIG. 9, another reel, generally designated 210, having a reel shaft 211 projecting transversely from a knob 212 and terminates in a fastener boss for attachment with the housing as described herein above. Cantileverly mounted from the knob and projecting transversely along the reel shaft is a resilient retaining clip 213. The clip may be alternatively secured at one end to the reel shaft near the knob. At the free end of the clip 214 is a rounded stop 215 that projects radially inwardly from the clip to abut the reel shaft. A knoblike stud 216 projects radially outwardly from the reel shaft and abuts the interiorly disposed surface of the clip. The closed end of the tube may be inserted transversely along the reel shaft and beneath the clip to engage both the stop and the stub which cooperate to retain the tube on the reel shaft. The tube is held in place between the reel shaft and the retaining clip by the resilience of the clip. A tube such as that shown in FIG. 11 is preferably used in conjunction with this dispenser because the openings provide additional security to the tube and reel assembly in both the transverse and longitudinal directions. Additionally, assembly time is decreased because no winding is required to secure the tube to the reel shaft.

Referring now to FIGS. 10–11 another modification of the reel 220 is shown. A tube 221 may be inserted from either longitudinal side of the open slot 222 that projects diametrically through the reel shaft 224. This enhances assembly of the dispenser unit by reducing the time to align the connector slot with the housing slot because of the provision of two entry points for the end of the tube. The connector includes oppositely projecting stubs 226 that allow the closed end of the tube to be inserted into the slot openings from either direction and be retained therein. The stubs are constructed within the slot with a space therebetween to allow the closed end of the tube to slide over one pair of stubs and once clear of the stubs, the tube would be inhibited from being withdrawn as the rearwardly projecting stub relative to the tube would engage the closed end of the tube. As shown in FIG. 11, a conventional tube having a pair of stub receiving openings 228 could be used for increased retention strength. While a tube approaching from only one side is shown in FIG. 11, it is to be understood that the configuration is constructed to accept a tube from either opposing side of the reel through only a 180 degree rotation of the knob.

A second embodiment of the present invention, generally referred to as 300, is illustrated in FIGS. 12–15 wherein the braking elements are disposed in an alternate location. The second embodiment includes a hollow cylindrical housing 302 and a reel 304 having a reel knob 306. The housing 302 is formed with a generally cylindrical outer shell 308 defining a storage compartment 310. A slot with flattening edges (not shown) is constructed as shown in FIG. 1.

Figure 12:
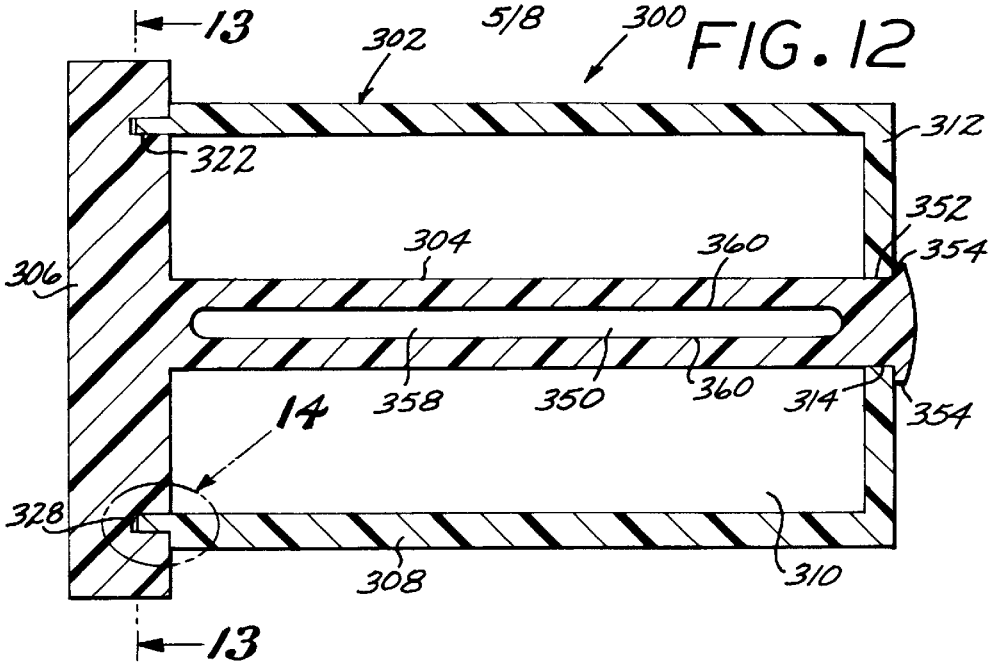
FIG. 12 is a longitudinal sectional front view of a second embodiment of the dispenser apparatus of the present invention.
Figure 13:
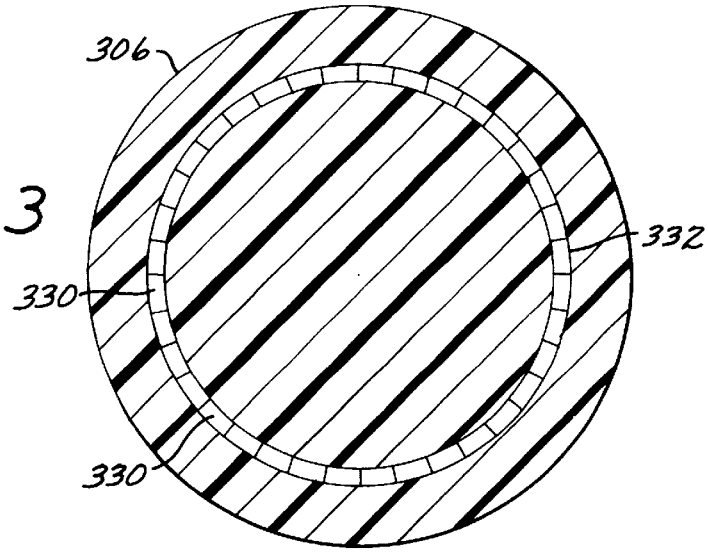
FIG. 13 is a cross sectional end view taken along lines 13—13 of FIG. 12.
Figure 14:
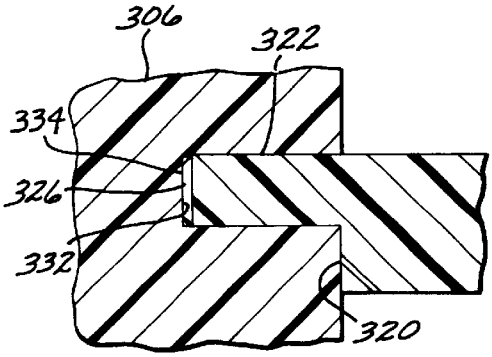
FIG. 14 is an enlarged detail view taken from the oval 14 in FIG. 12.

With continued reference to FIGS. 12–15, the housing 302 is closed on one end with an end wall 312 formed with an axial through bore 314 for receipt of one end of a reel shaft. The shell 308 is formed at its opposite end with an opening configured with a reduced in diameter annular flange 322 defining an axially outwardly facing annular shoulder 320. With continued reference to FIG. 12, the knob 306 is formed on its inside surface with an axially inwardly opening annular groove 332 that slidably receives the annular flange 322 for rotation thereof. At the outer extremity of the annular flange is a first braking element 326 in the form of an axially projecting resilient pawl 328. The pawl may be singular or may include several pawls spaced along the lip. The second braking element 330 is formed with a series of teeth and is located in an annular groove 332 facing the pawl 328 and located on the interior surface 334 of the knob 306 as shown in FIGS. 12–14. The annular flange 322 is constructed to receive the flange 322 and the first braking element 326 to interact with the second braking element to resist unreeling of the tube secured to the reel by cooperate to form a one-way rachet device for restraining rotation of the reel in one direction. At the same time, the groove and flange provide additional structural integrity to the shell of the housing. The braking elements could be also be transposed.

Figure 15:
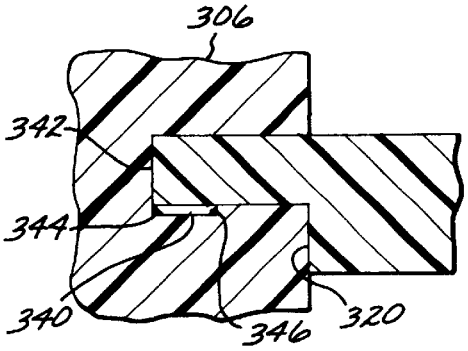
FIG. 15 is a sectional view similar to FIG. 14 depicting an alternative braking system.

FIG. 15 depicts an alternate braking configuration wherein a first braking element 340 in the form of a pawl projecting radially inwardly from the flange 342 engages a second braking element 344 formed by annularly arranged teeth facing radially outwardly from the radially interior surface of a slot 346.

Referring now to FIG. 12, in either braking embodiment shown in FIGS. 14 and 15, the reel 304 includes a spindle 350 that projects laterally from the knob 306 to extend laterally through the storage compartment 310 and terminate in a journal 352 that turns within the bore 314. Extending past the journal is a mounting shoulder 354 that is flexible to snap into the bore 314 but resilient enough to permanently secure the reel to the housing. The reel further includes a retainer (not shown) that may take the form, for example of the connector illustrated in FIG. 10 to receive and retain the closed flattened end of a tube.

In accordance with another embodiment of the present invention, as illustrated in FIG. 16, a dispenser apparatus, generally designated 370, includes a cylindrical housing 372 having an elongated peripheral shell 374 defining a take-up compartment 376. An elongated compression slot (not shown), is constructed as shown in FIG. 1 and enables access for a tube from the exterior of the housing into the take up compartment and compresses the tube as it is drawn into the compartment. At one end of the housing is an end wall 378 defining a through bore 384 for receipt of one end of a reel 386. The opposite end of the housing is open to terminate in a circular abutment edge 388. Formed on the interior surface of the end wall 378 is an inwardly facing annular groove 392 surrounding and concentric with the through bore 384. Formed in such groove is an arrangement of axially outwardly gear teeth 396.

Still referring to FIG. 16, a reel 386 includes a reel shaft 398 projecting axially from a cylindrical knob 414. A connector (not shown) such as the one exemplified in FIG. 10 attaches to the closed end of the tube and retains it therein. The reel shaft terminates on its free extremity in a reduced in diameter journal 404 constructed to rotate within the through bore 384 and a resilient circular flange 406 defining an axially enlarged shoulder facing the end wall of the shaft body and spaced therefrom for sandwiching therebetween the thickness of the end wall 378. The reel shaft is constructed with an enlarged diameter in relation to the journal to locate an axially directed braking pawl 408 at the outer circumference of the reel to engage the teeth 396 in the groove 392. Formed on the axially inside wall of the knob 414 is a bearing disc 412 constructed to nest inside the open end of the housing and rotate relative thereto.

In another embodiment of the present invention a transposition of braking elements is illustrated in FIG. 17. In this embodiment, the end wall 434 of the housing includes a recessed circular seat 436 formed interiorly of a through bore 437. Projecting radially inwardly into such seat is a resilient braking pawl 438. A reel 442 includes at its free extremity an enlarged radially projecting disc 444 that resides partially within the seat and terminates in a fastener boss 445, preferably constructed for permanent engagement with the end wall of the housing. The disc and boss are rotatably coupled to the seat. This disc includes a second braking device 440 on its circumference in the form of gear teeth constructed to engage the pawl and resist rotational movement of the reel in one direction.

Figure 18:
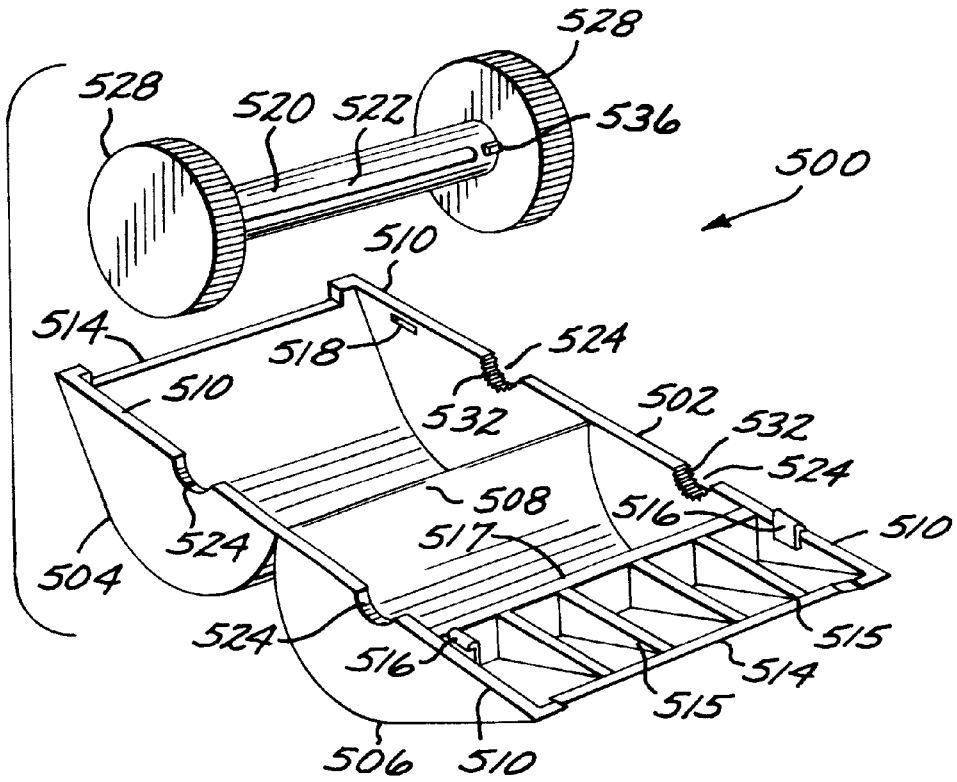
FIG. 18 is an exploded perspective view of a further embodiment of the dispenser apparatus of the present invention.
Figure 19:
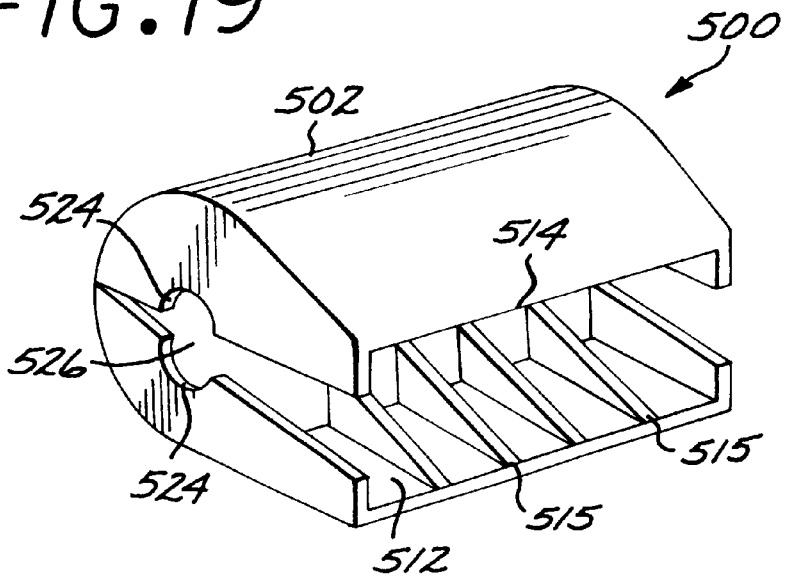
FIG. 19 is aperspective view of FIG. 18 showing the housing partially closed without the reel.

In an alternative embodiment, a dispensing apparatus, generally designated 500, as exemplified in FIGS. 18–19, the housing 502 may take the form a clam shell having a first half 504 and a second half 506 connected together along one side by a transversely projecting hinge 508. The housing is constructed with laterally disposed confronting edges 510 that abut when the housing is closed. The hinge enables the first and second halves to rotate and close on one another to form a take up compartment 512. The flattening edges 514 oppose the hinge when the housing is closed. These edges are disposed at one end of a series of ribs 515, shown here on the one half only. The ribs project into the housing toward the reel shaft and are formed with a tapered edge to proximate the contour of the collapsible tube to maintain compressive forces on the tube to push the flowable material toward the opening of the tube. The interior portion of each respective rib abuts a compressing wall 517 which cooperates with a second wall on the opposing half (not shown) to form a narrow slot for compressing the tube internal to the housing. The internal compressing wall may provide the forces required to flatten the tube walls and thereby allow an alternate configuration in which the space formed between flattening edges 514 is enlarged or contoured to provide an aesthetic transition onto the tube walls. The ribs additionally allow excess material to be removed thus reducing cost of the dispenser. While the ribs and the wall are only shown on one half of the housing for illustrative purposes, in the preferred embodiment, a set of ribs and a compressing wall would be located on both halves of the housing.

The first and second halves include forwardly disposed extended surfaces 514 to locate the flattening edges further away from the reel and increase the size of the take up compartment. Varying degrees of curvature may be introduced into the flattening edges to complement the contour of the tube and provide a more aesthetic blended singular unit appearance between the tube and the dispenser unit. The hinge may formed of a thin piece of flexible plastic material connecting the two halves or a conventional pinned hinge may be used. The first half and second half are held together by plastic locking tabs 516 in one of the halves cooperating with recesses 518 on the other half.

The reel shaft 520 includes a connector 522 in the form of any of the connectors previously described, such as FIG. 10, for engaging the closed flattened end of the tube and enabling the tube to be drawn into the take up compartment 512. Each half of the hinged housing 502 contains a pair of centrally disposed semi-circular cut outs 524 cooperating, when the first half and 504 second half 506 are locked together, to form nesting bores 526 to receive cylindrically shaped opposite extremities of the reel shaft 520 which terminates at opposite ends in a pair of knobs 528 fixed to the reel shaft. As is understood by those skilled in the art, the knob reel assembly could be one piece or could be made up of discrete components that snap together. The nesting bores are dimensioned to allow rotation of the reel shaft and include a peripheral mounted first braking element 532 in the form of ratchet teeth similar to the embodiment of FIG. 3. The reel shaft includes a second braking element 536 in the form of a pawl extending from the reel shaft for engaging the first braking element to resist rotation in one direction. Either knob can be turned to wind the tube into the take up compartment 512.

Figure 20:
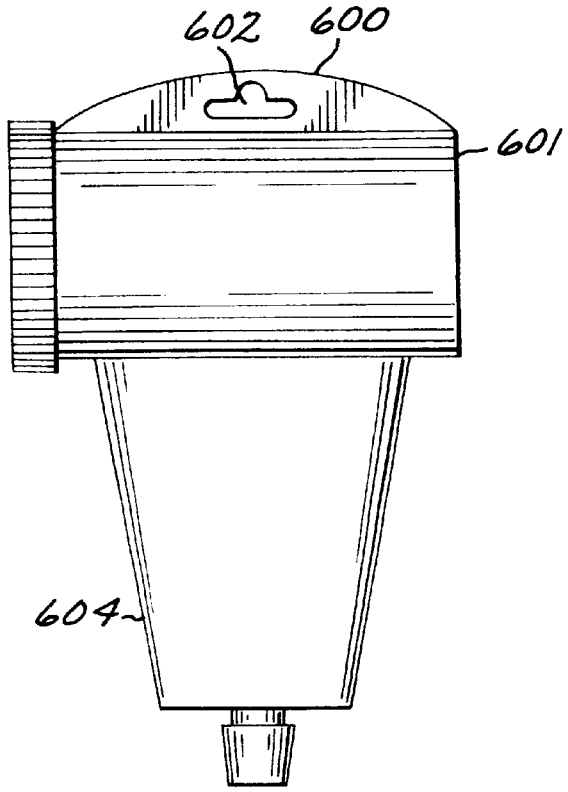
FIG. 20 is a reduced top view of a modified housing shown in FIG. 1 having a peg opening.

FIG. 20 shows another feature of the present invention in the form of a fin 600 projecting from the exterior surface of the housing 601. Formed centrally in the fin is a peg hook opening 602 for engaging a hook mounted to a vertical surface to hang the device in a convenient location at home or from a shelf in a store. The attached tube 604 hangs down from the housing allowing gravity to assist dispensing the contents within if the dispenser is operated while in the hanging position.

Figure 21:
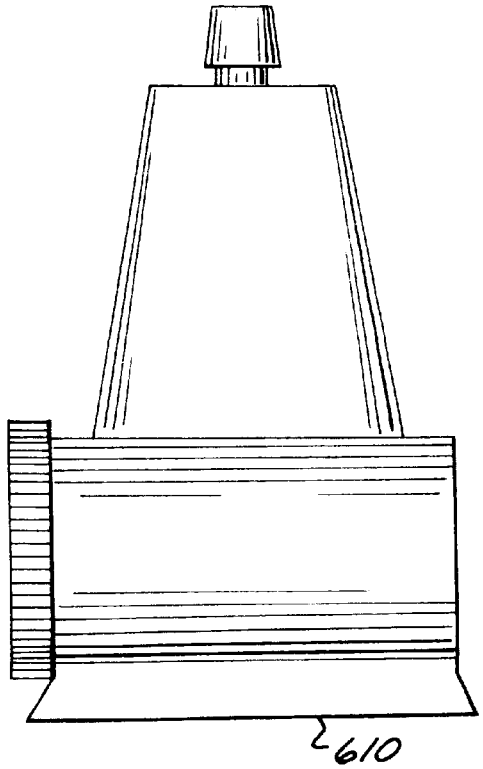
FIG. 21 is a reduced top view of another modified housing shown in FIG. 1 having a stand.

FIG. 21 illustrates another useful modification of the present invention. One side of the housing is configured with a base 610 having a planar surface such as the foot shown opposing the slot in the housing so that the entire assembly may be placed upright in a storage position for display in the marketplace or at home on a countertop. The slot of the housing acts to center the tube over the base to keep the unit upright when placed on a flat surface.

The housing, reel, knob and braking elements described herein are preferably constructed of lightweight rigid plastic. Components that are frictionally engaged such as the braking elements may be formed of a sturdier plastic to resist wear. Other materials known in the art and suitable for such use, such as metals, that are capable of being formed in the above recited manner may also be used. In addition, some of the components may be constructed from different materials than the other components.

Figure 4:
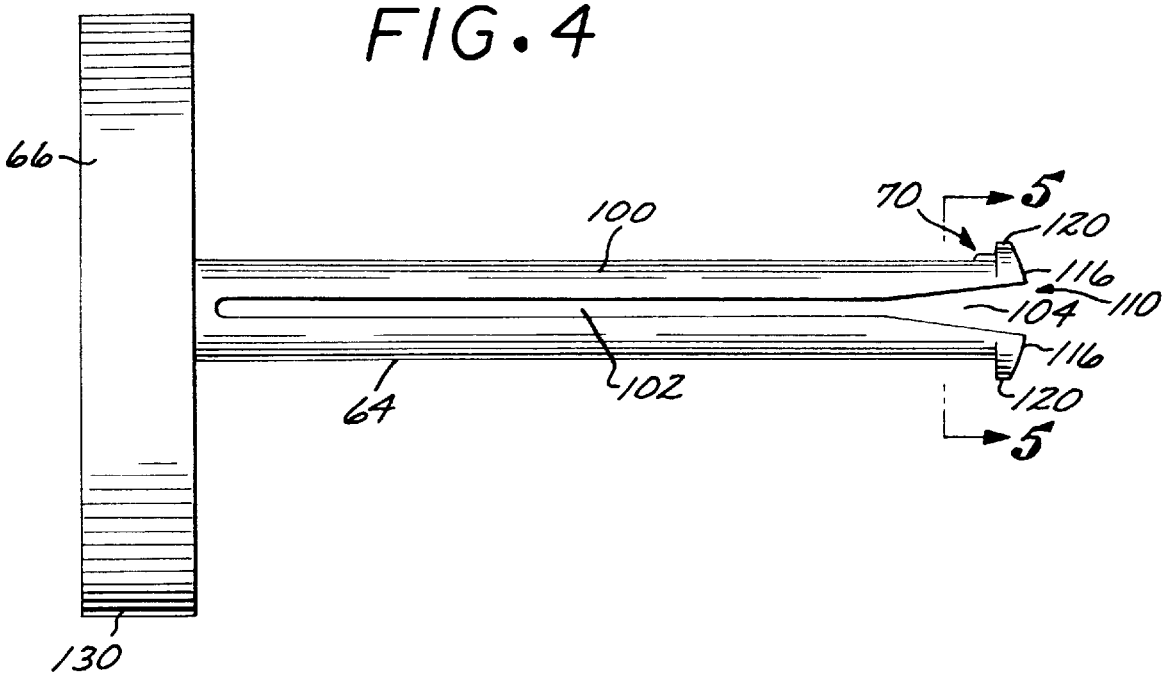
FIG. 4 is a front view of the reel and knob shown in FIG. 2.
Figure 5:
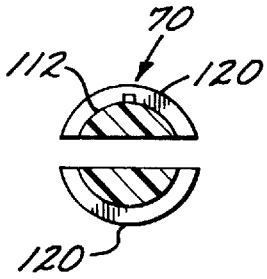
FIG. 5 is cross sectional view taken along lines 5—5 of FIG. 4.

The components described herein may be integrally formed or may constitute discrete components or a combination thereof. For example, the reel and knob assembly in FIG. 4 is shown as in integral unit with a discrete housing member. In practice the dispenser could be made up of multiple components such as a discrete reel and a discrete knob or the housing could include two discrete halves snapped together. More than one knob could be used such as that shown in FIG. 18 and the shapes of the knobs could vary considerably. A housing having two open ends may be used in conjunction with a knob or cap abutting the housing and providing an interiorly facing surface formed with the end wall features recited herein. Other braking elements that prohibit rotation in one direction may also be used in the present invention. The braking elements may also be transposed between components or may be recessed into their respective components as opposed to projecting from the component. Other variations are available to those skilled in the art that would fall within the scope of this invention.

In operation, the dispenser apparatus of the present invention provides for incremental flow control of the contents of a flexible walled tube while resisting unwinding of the tube 61. For purposes of this example, a reel as shown in FIG. 4 is used and is integrally formed with the knob. Referring to FIGS. 1–5, the operation of an unassembled dispenser apparatus 60 is initiated by inserting the closed flattened end of a flexible walled tube 61 into the slot 102 of the reel 64. The reel, knob 66, and tube combination is then slid into the housing 62 with the tube walls sliding transversely through the open end 79 of the slit 78 and between the flattening edges 76 of the housing. The reel is then preferably permanently engaged with the housing by pushing the fastener boss 110 through the bore 82 until the radial outward flanges 120 of the flexible tines 116 are abutting the exterior surface of the end wall 80. The resilience of the tines ensures a permanent fit with the housing. The insertion of the reel into the end wall also aligns the teeth 86 with pawl of the second braking element 70 in interlocking relation to one another and completes the assembled unit.

If the tube has a cap or other lid it is removed and the tube is manually squeezed to dispense the contents therein. After squeezing the tube and dispensing a portion of the contents, the collapsible tube may be wound up as needed by the dispenser to force the contents toward the opening and take up the used portions into the housing.

To wind up the tube 61, the knob 66 is grasped by the hand grip portion 130 and turned in either a clockwise direction or counterclockwise direction depending on the one-way rotational restriction enforced by the cooperating braking elements. The rotation of the knob rotates the adjoining reel 64 to wind the tube initially around the outer surface of the reel and then upon itself. This rotation also draws the tube between the flattening edges 76 of the housing 62 which compress the tube walls and force the contents of the tube toward the opening. The winding of the tube around the reel and the flattening edges prevent the contents of the tube from moving away from the open end. The rotation of the knob is generally continued until the used portion of the tube is taken up into the take up compartment 74. The tube may then be capped or sealed until the next use.

Although it is preferable to permanently attach the tube end to the reel and the reel to the housing, if a less permanent device is assembled, removing a tube 61 requires the knob 66 to be engaged by the user and pulled in a transverse direction away from the housing 62. A less resilient fastener boss 110 used for releasable engagement will converge and release from the bore 82 and the entire reel 64, knob and tube can be removed out of the take up compartment 74 of the housing. The tube is then unwound and the closed flattened end is slid from the slot 102 of the reel which is then ready to receive a different tube.

It is also within the scope of the present invention to incorporate a tube having an elongated tail to provide a releasably engageable attachment between the reel and the tube. The end of the elongated tail of the tube may be slid into the slot of the reel and then the reel is manually or mechanically turned a sufficient number of turns to wind the tail of the tube upon itself thereby preventing the tube from being pulled away from the reel. The slot would not have to be narrowly dimensioned to compress the sides of the tube and some material may be saved through the use of this structure. Use of this reel and tube assembly is less preferred because of the additional step required to wind the tube onto the reel to prohibit the tube from slipping off the reel. The braking elements of the present invention would still provide an effective means of resisting the unwinding of the tube and controlling the contents of the tube.

An alternate method of assembly could also be employed. The knob 66 and reel 64 could be placed within the housing 62 and snapped into place. The flattened end of the tube 61 is then inserted into the slit 78 of the housing and into the slot 102 of the reel with a connector such as illustrated in FIG. 10. The winding of the tube into the housing is performed as described above.

While several forms of the invention have been illustrated and described, it will also be apparent that various modifications may be made without departing from the spirit and scope of the invention.

What is claimed is:

1. Apparatus for mounting on the flattened closed end of an elongated collapsible wall tube to dispense the contents therefrom and comprising:

an elongated housing formed with a take up compartment and transversely elongated flattening edges spaced apart to form a slit for a sliding receipt of the opposite sides of the wall of the tube, said housing being formed with a pair of clam shell halves connected together along one side by hinge, said halves being rotatable about said hinge to close on one another and form said compartment;

a plurality of tapering support ribs originating proximate said flattening edges and extending into said take up compartment;

a first brake element mounted on said housing;

a transverse reel in said compartment rotatably mounted from said housing and including a reel shaft having a connector for connecting with the closed end;

a second brake element on said reel and engageable with said first brake element to break against rotation thereof; and a knob on said reel for rotation thereof whereby said closed end may be inserted through said slit and engaged with said connector so that said knob may be rotated to reel said closed end up on said shaft to draw said tube progressively through said slit to engage the opposite side of the tube wall and said brake elements cooperating to brake said reel against unreeling.

2. Apparatus of claim 1 wherein:

said connector is constructed to be permanently affixed to said tube.

3. Apparatus of claim 1 wherein:

said first brake element is in the form of ratchet teeth; and said second brake element includes at least one pawl for releasably engaging said ratchet teeth.

4. Apparatus of claim 1 wherein:

said halves being formed with opposite lateral end walls configured to terminate in edges contacting one another when said clam shell halves are in their closed position; and said edges being configured medially with semi-circular cut outs cooperating to form respective nesting bores receiving the opposite extremities of said shaft.

5. Apparatus of claim 1 wherein:

said reel is configured with the transverse slot defining said connector.

6. Apparatus of claim 1 wherein:

said housing includes a base constructed to hold said tube in an upright position.

7. Apparatus of claim 1 wherein:

said housing includes a surface defining a hook opening.

8. Apparatus of claim 1 wherein:

said first break element includes at least one pawl; and said second brake element is in the form of a series of ratchet teeth configured to inhibit rotation in one direction of said reel and permit rotation in opposite direction.

9. Apparatus of claim 1 wherein:

said shell halves include complementary fasteners for snapping said halves together.

10. Apparatus for mounting on the flattened closed end of an elongated collapsible wall tube to dispense the contents therefrom and comprising:

a housing formed with an upper half and a lower half constructed to abut one another and cooperating at their free extremities to form a compression slit, said halves being formed with opposite lateral end walls configured to terminate in edges contacting one another when said halves are in abutting relation, said edges being configured medially with semi-circular cut outs cooperating to form respective nesting bores;

a plurality of inclined compression ribs originating proximate said free extremities and extending into said take up compartment;

a first braking element mounted within at least one of said nesting bores;

a reel including a reel shaft including a connector for connecting with the closed end and having a second braking element constructed to engage said first braking element to inhibit one way directional rotation of said reel, said reel shaft further configured on its opposite extremities to nest in said nesting bores and be rotatably received therein; and a knob mounted on one extremity of said reel.

* * * * *